US005709386A

United States Patent [19]

Nelson

[11] Patent Number: 5,709,386

[45] Date of Patent: Jan. 20, 1998

[54] APPARATUS FOR ROPING TRAINING

[76] Inventor: Leland Nelson, 401 W. Maple, Mapleton, Utah 84664

[21] Appl. No.: 644,661

[22] Filed: Apr. 24, 1996

[51] Int. Cl.[6] ..... F41J 9/02; A63B 69/00; A63G 19/00; A63H 11/00

[52] U.S. Cl. ..... 273/370; 273/338; 434/247; 446/353

[58] Field of Search ..... 273/336–339, 273/348, 359–360, 367–370; 434/247; 446/330, 352, 353

[56] References Cited

U.S. PATENT DOCUMENTS

| | | | |
|---|---|---|---|
| 3,776,553 | 12/1973 | Kelton | 273/105.2 |
| 3,802,706 | 4/1974 | Hamm | 273/105.2 |
| 3,947,033 | 3/1976 | Bennett | 273/105.2 |
| 4,136,874 | 1/1979 | McCord | 273/105.2 |
| 4,286,788 | 9/1981 | Simington et al. | 273/359 |
| 4,451,045 | 5/1984 | Fesmire | 273/338 |
| 4,874,179 | 10/1989 | Henderson | 273/338 |
| 4,960,076 | 10/1990 | Snorgras et al. | 119/29 |
| 4,981,302 | 1/1991 | Narramore | 273/339 |
| 4,995,618 | 2/1991 | Panzer | 273/369 |
| 5,009,432 | 4/1991 | Richard | 273/339 |
| 5,080,373 | 1/1992 | Jones | 273/338 |

*Primary Examiner*—Robert A. Hafer
*Assistant Examiner*—Laura Fossum
*Attorney, Agent, or Firm*—J. David Nelson

[57] ABSTRACT

An apparatus for use in roping skills training and practice. This invention is designed particularly for providing a practical, effective, lightweight and economical alternative to live animal practice for "heeling", the roping of the hind legs of steers and calves for rodeo team roping events. This apparatus includes a hollow simulated animal torso or full body with simulated hind legs. The apparatus has a simple support frame and is energized by a DC motor and 12 volt battery. A finger adjusted, spring loaded transmission provides for adjusting the speed of the leg and body movement. A unique cam arrangement and an interconnection between the simulated animal body and the simulated legs provides for lifelike coordinated leg and body movement.

29 Claims, 3 Drawing Sheets

APPARATUS FOR ROPING TRAINING

FIELD OF THE INVENTION

This invention relates to devices for roping skills training, and particularly, to training devices for heeling skills training.

BACKGROUND OF THE INVENTION

Interest in developing roping skills and in roping competition has steadily increased since the days of the origination of these skills as work and survival tools for cattle ranching operations. One of the inherent difficulties in developing roping skills, particularly for hind leg roping, has been historical reliance upon live animals and access to an elaborate practice facility. Not only is interest in developing leg roping skills increasing as a result of a growing interest in roping competition, but also leg roping skills continue to be important for bull handling, calf branding and other cattle ranching activities.

For the competition event of team steer roping, because of the mechanics of the steer movement, the task of roping the hind legs, "heeling", requires split second timing and is commonly thought to be considerably more difficult than roping the head. Therefore, for success in team roping it is more crucial for the team member responsible for roping the hind legs, the heeler, to have an opportunity to engage in a considerable amount of repetitious practice.

Due to a limited number of practice animals and limited facilities for practicing, the repetitive practice of roping skills on live animals is not practical or humane because of the cumulative stress and distress imposed on the animals. Furthermore, obtaining and maintaining a collection of livestock and a large arena with the required facilities is very costly. Therefore, there has long been a need for alternative means for practice and training.

A number of different kinds of apparatuses have been developed through the years to assist in the training of heelers as well as headers, the team members who rope the head of the animal. The simplest such apparatus is a stationary practice dummy which allows a trainee to practice basic roping skills while standing on the ground or sitting on a horse. While this apparatus provides for virtually unlimited training opportunities at a minimal cost, it is of very limited value in developing the necessary timing skills for successful roping competition. There have been a number of more advanced devices developed to assist in training of heelers, each simulating the rear leg movement of a running steer or calf, with varying degrees of effectiveness, complexity and cost. Some of the more complex and costly devices also provide for simultaneous simulation of body movement. Notable among the devices include the devices disclosed in the following U.S. Patents:

U.S. Pat. No. 3,776,553, Kelton, December 1973
U.S. Pat. No. 3,802,706, Hamm, April 1974
U.S. Pat. No. 3,947,033, Bennett, March 1976
U.S. Pat. No. 4,136,874, McCord, January 1979
U.S. Pat. No. 4,266,779, English, May 1981
U.S. Pat. No. 4,286,788, Simington, September 1981
U.S. Pat. No. 4,451,045, Fesmire, May 1984
U.S. Pat. No. 4,640,515, Rhine, February 1987
U.S. Pat. No. 4,662,642, Archibald, May 1987
U.S. Pat. No. 4,874,179, Henderson, October 1989
U.S. Pat. No. 4,981,302, Narramore, January 1991

U.S. Pat. No. 5,009,432, Richard, April 1991
U.S. Pat. No. 5,080,373, Jones, January 1992

Each of these devices fails to meet one or more of the obvious objectives for such a training apparatus. Some of them are complex, expensive and heavy like the device disclosed by Jones in U.S. Pat. No. 5,080,373, or fall far short of authentically simulating leg and body movement of a steer, like the devices disclosed by Narramore in U.S. Pat. No. 4,981,302, by Henderson in U.S. Pat. No. 4,874,179 and by Fesmire in U.S. Pat. No. 4,451,045. Perhaps the best means disclosed in the prior art for simulating both the leg movement and body movement is disclosed by Jones in U.S. Pat. No. 5,080,373. However, this apparatus is very expensive and incorporates an elaborate and heavy frame which is enshrouded by a simulated animal body which is merely attached firmly to a frame.

One object of the present invention is to provide a roping training device which more closely simulates the anatomy and body and leg movement of a running steer than prior art devices. A further object of the present invention is to provide a roping training device which allows for ready adjustment in the speed of leg and body movement, thereby simulating an animal running at varying speeds. A still further object of the present invention is to provide a roping training device which is lighter in weight in comparison to prior art devices. A still further object of the present invention is to provide a roping training device which is substantially lower in cost than prior art devices. A still further object of the present invention is to provide a roping training device with a simple frame structure which incorporates a thin body shell as part of the structure. A still further objective of the present invention is to provide a roping training device that can be pulled behind a motorized vehicle such as a pickup truck or an all-terrain vehicle. A still further objective of the present invention is to provide a roping training device which is easy and economical to maintain, has replacement parts which are economical and readily obtainable, and which can ordinarily be serviced and maintained by the user. A still further objective of the present invention is to provide a roping training device which utilizes a smaller amount of electrical power in comparison to prior art devices. A still further objective of the present invention is to provide a roping training device which is portable and has its own power source and, therefore, can be used at locations where there is no source of power.

SUMMARY OF INVENTION

The roping training apparatus which is the present invention consists of a simulated animal body which is a hollow shell formed to simulate at least the torso and hind quarters of an animal; simulated hind legs for the animal pivotally attached to the interior of the shell at the respective anatomical hip locations; two cams, one attached to each leg and connected by a common shaft to a common drive pulley located inside the shell of the simulated animal body; a tubular frame member extending from the rear of the simulated body toward the front of the simulated body, with the drive pulley attached at the rear end; a front body pivot shaft pivotally connected to the tubular frame member at the forward end of the simulated animal body; a drive motor or engine attached to a tubular sleeve, the geometry and internal dimensions of which are such that it securely but readily slides upon the tubular frame member; a motor pulley which is connected by a drive belt to the drive pulley; a threaded shaft attached to the rear end of the tubular frame member and extending to the motor sleeve, providing for the adjustment of tension on the belt which connects the motor pulley and the drive pulley; a spring loaded transmission which varies the simulated running speed based upon the tension on the drive belt; support frame to which the tubular frame member is attached at the front of the tubular frame member, said support frame being adjustable to allow the lowering and the raising of the simulated animal; a battery or other power supply if a motor is used rather than an engine to energize the simulated animal; and a spring attached to the top of the support frame and the top of the simulated animal torso, providing for reduction in the force and energy required of the motor or engine to energize the simulated animal body and reducing vibration.

As the drive motor and belt rotate the drive pulley, the cams rotate, causing the simulated legs to swing about their pivot point in the animal body and causing the rear of the simulated animal body and the swinging legs to move up and down. Thus the feet move back and forth in concert with the up and down movement of the rear of the simulated animal body. This combination of back and forth foot movement and up and down body movement, closely simulates the natural movement of a running animal, making it very useful in roping practice. By adjusting the tension on the belt, the spring loaded transmission adjusts the speed of animation of the simulated animal.

DETAILED DESCRIPTION OF PREFERRED EMBODIMENTS

Figure 1:
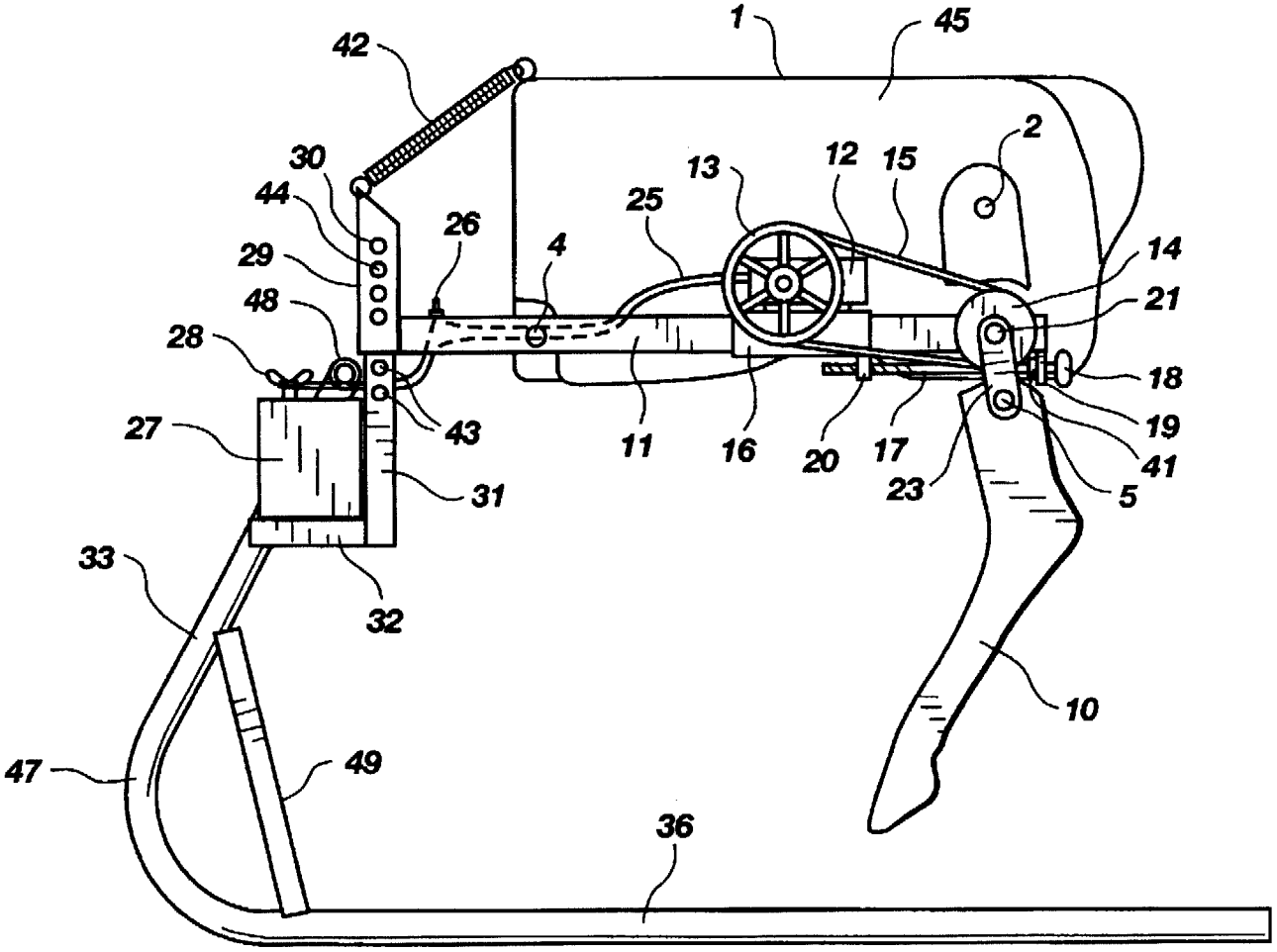
FIG. 1: A side view sectional elevation of a preferred embodiment.
Figure 2:
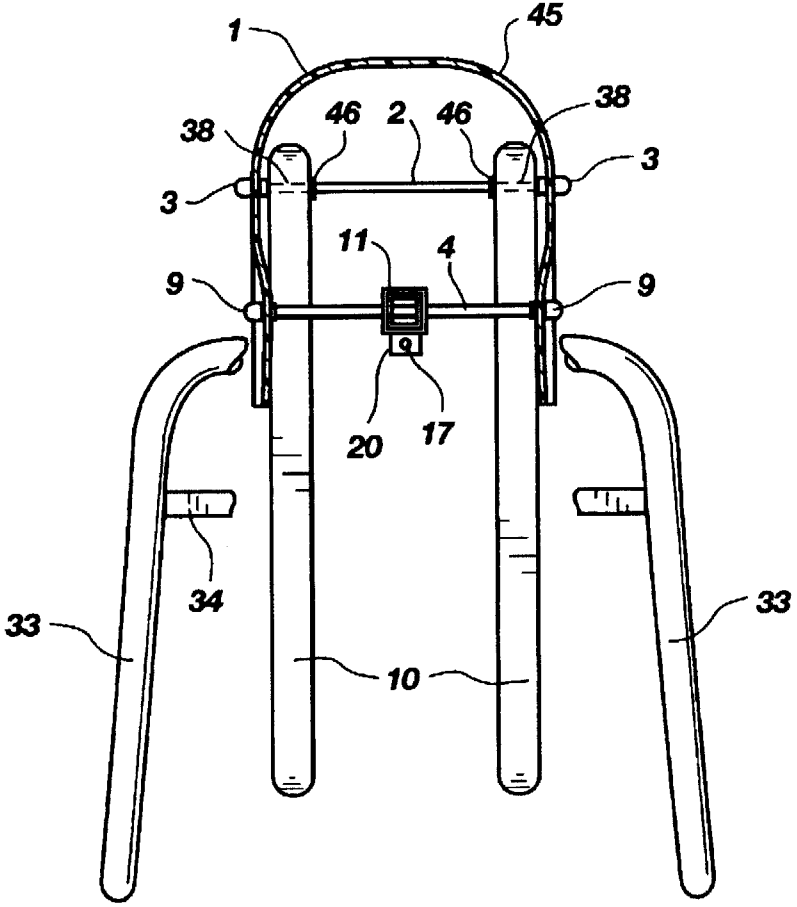
FIG. 2: A front view sectional detail showing the body pivot shafts of a preferred embodiment.

Referring first to FIG. 1 there is indicated generally therein a sectional side view of a preferred embodiment of the invention. Under this preferred embodiment, a simulated animal torso 1, preferably comprising a thin shell 45 of molded resilient material that is connected by means of a rear body pivot shaft 2 to a pair of simulated hind legs 10, and to a central structural member 11 by means of a front body pivot shaft 4. Referring to FIG. 2, a front view sectional detail, the rear body pivot shaft extends through both sides of the shell 45 and is secured in place by rear body pivot shaft lugs 3 attached to the ends of the shaft. Likewise, the front body pivot shaft extends through both sides of the shell 45 is secured in place by front body pivot shaft lugs 9.

Figure 3:
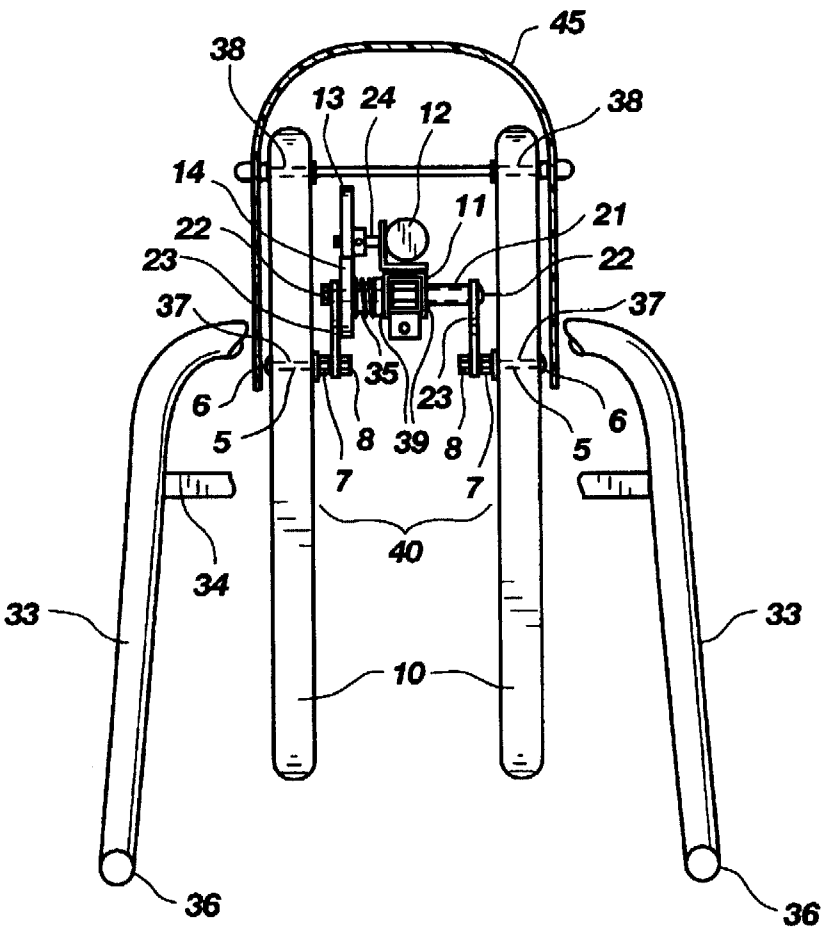
FIG. 3: A rear view sectional detail showing motor, drive and hind legs of a preferred embodiment.

Referring now to FIG. 3, a rear view sectional detail, the simulated hind legs are connected to a drive mechanism 40 by hind leg pivot shafts 5 which pass through hind leg pivot shaft openings 37 in the hind legs. The drive mechanism 40 is comprised of a drive pulley 14, a drive shaft 21, two drive cams 23 and a spring loaded transmission 35. The drive mechanism is firmly attached to a central structural member 11, which, under preferred embodiments, is a tubular metallic beam. The drive shaft 21 passes through openings 39 in the central structural member. A drive cam is secured to each end of the drive shaft by a fastener 22. The drive shaft passes through the desired axis of rotation of the drive cams. The hind leg pivot shafts 5 are each secured to the displacement end of a drive cam by fasteners 7, 8. Each simulated hind leg is secured to a hind leg pivot shaft by a lug or other fastener 6. Under some preferred embodiments, the hind leg pivot shaft openings 37 are each equipped with a sleeve to provide for close tolerance and a free and durable contact surface with the hind leg pivot shafts. For other preferred embodiments, each of the hind leg pivot shaft openings are equipped with a bearing for free and durable contact between the opening and the shaft. The rear body pivot shaft 2 passes through the top of each of the simulated hind legs through top leg shaft openings 38. For some preferred embodiments these openings are also equipped with sleeves or bearings.

Referring again to FIG. 1, the drive mechanism 40, under preferred embodiments, is connected to a drive motor 12 by a belt 15. Other embodiments may provide for a chain connection between the drive mechanism and the drive motor. The use of a belt allows the use of a spring loaded transmission 35 to govern the energy transfer to the drive shaft 21. The drive motor 12 is mounted upon a motor mount 16 which, under preferred embodiments, is comprised of a section of hollow metallic tubing, the internal dimensions of which are slightly greater than the external dimensions of the central structural member thereby providing for the back and forth movement or tracking of the motor mount 16 upon the central structure member 11. The tension on the drive belt is controlled by the drive tension shaft 17 which is connected to the motor mount by a threaded receptacle 20 and is connected to the rear end of the central structural member by tension shaft bracket 19. The tension shaft passes through an opening in the tension shaft bracket 19. A twist knob 18 allows a finger grip by user for use in adjusting a tension on the drive belt 15. A tension shaft collar 41 provides a contact between the tension shaft and the tension shaft bracket and provides for the transfer of force from the tension shaft to the motor mount 16.

The central structure member extends from the drive mechanism 4 along the axis of the simulated animal body to connect with a vertical frame member 31. For preferred embodiments a vertical structural sleeve 29 is welded or otherwise attached to the central structural member at the front end of the central structural member. The vertical structural sleeve is a section of tubular metallic beam which slides, with close tolerance, over the vertical frame member 31. The vertical frame member 31 has a series of openings 43 passing through both sides of the vertical frame member at a plurality of elevations and the vertical structural sleeve has a series of series of openings 30 passing through both sides of the vertical structural sleeve at a plurality elevations. The height of the simulated animal torso 1 above ground level during use is adjusted by sliding the vertical structural sleeve 29 up and down to the desired level and inserting a pin 44 through a vertical structural sleeve opening 30 and an aligned vertical frame member opening 43.

Figure 4:
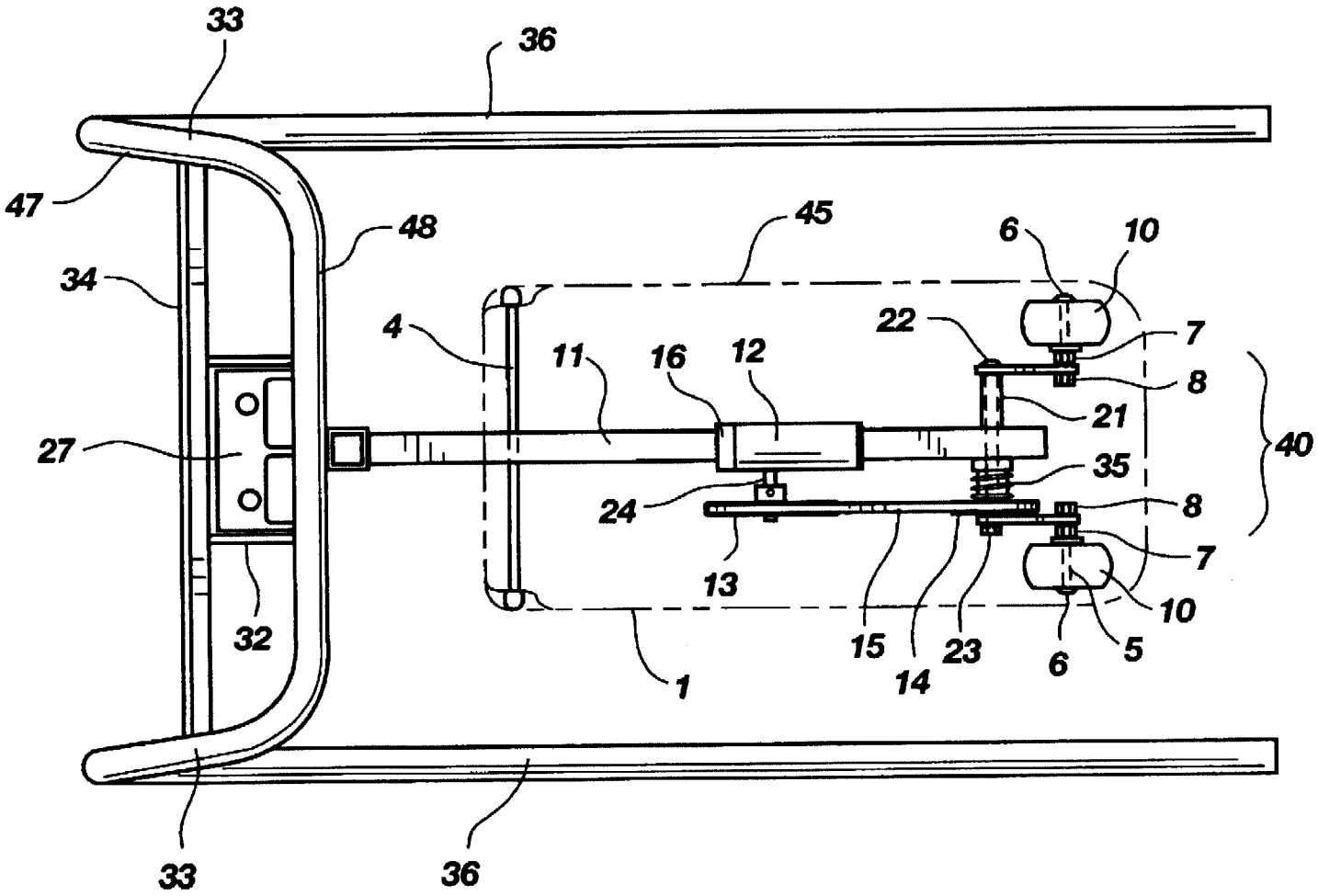
FIG. 4: A top view sectional detail of a preferred embodiment.

Referring to FIG. 4, a top view sectional detail, a support frame 47 is comprised of a horizontal support frame member 48 which is attached to the top of two opposing vertical support frame members 33 which is each attached to the front end of a skid frame member 36. Sliding of the support frame across the ground during normal use is facilitated, under preferred embodiments, by having skid frame members curved up on the front end as shown in FIG. 1. Under preferred embodiments, the support frame 47 is comprised of tubular metallic material. The horizontal support frame member 48 of the support frame is attached to the central structural member 11 by welding, bracketing or other suitable means. The support frame provides stability and further provides for the towing or pulling of the present invention, sliding on the skid frame members 36. A brace 49, which is welded or otherwise attached to the vertical support frame members and the skid frame members, provides additional structural stability.

Referring again to FIG. 1, for preferred embodiments the drive motor 12 will be a 12 volt DC motor connected by cable 25 to an off switch 26 and a 12 volt battery 27 with terminal connectors 28. For other embodiments power can be supplied through an interconnection with a towing vehicle or another independent power source. Under preferred embodiments the battery 27 is secured to the vertical support frame members 33 by a battery support frame member 34 and a battery stand 32. The battery stand is attached to the battery support frame member and the vertical frame member 31.

Referring again to FIG. 3, the drive motor 12 of the preferred embodiments is connected to a motor pulley 13 by a motor shaft 24. Referring to FIG. 1, the drive motor 12 turns the motor pulley 13 which transfers power to the drive pulley 14 by means of the belt 15. The rotation of the drive pulley 14 causes the rotation of the cams 23 which in turn cause the back and forth and up and down movement of the simulated hind legs 10 and the up and down movement of the simulated animal torso 1. Other embodiments of the invention may utilize an engine instead of an electric motor.

Referring to FIG. 3, the speed of rotation of the drive pulley and the cams, and thus the speed of leg and body movement is controlled by the spring loaded transmission 35. The tension on the belt is controlled through the tension shaft 17 which is finger adjusted by the tension shaft knob 18. The drive pulley 14 is split radially into two halves which are urged together by the axial force of the spring in the spring loaded transmission. The two halves of the drive pulley form a deep "v" receptacle for the belt which extends radially toward the pulley shaft. As tension on the belt is increased by turning the tension shaft knob, the belt is forced deeper into the "v" between the two halves of the drive pulley, thereby further spreading the halves of the drive pulley and decreasing the effective diameter of the drive pulley. This increases the speed of the leg and body movement. Likewise, reducing the tension on the drive belt increases the effective diameter of the drive pulley and decreases the speed of leg and body movement.

The preferred embodiment shown in FIG. 1 may be towed at a desired speed by a tow rope or cable attached to the vertical frame member 33. The invention in tow slides along the ground by contacting the ground with the skid frame members 36. Other embodiments of the invention can provide for wheels to be installed in the skid frame members.

Further embodiments of the invention are self-propelled through the use of one or more separate motivating means or may be propelled by one or more separate engines.

Preferred embodiments of the invention utilize a load spring 42 to reduce the amount of force which must be imparted by the drive motor to raise the rear of the simulated animal torso to its highest position. This spring also reduces the amount of vibration induced in the invention as the legs and torso move. Under preferred embodiments, the spring is attached to the top of the front of the shell 45 and to the top of the vertical structural sleeve 29.

Other embodiments of the invention provide for a full simulated torso and a simulated head for heading practice and for simultaneous team practice of heeling and heading. The head may also alternatively be with or without horns. The torso and leg size may be steer size for competition practicing or may be any size from bull size to calf size, for practicing ranch skills. If a full torso with head embodiment is utilized and the apparatus is to be used for heading practice, the load spring 42 must be attached inside the shell, and the head must extend and cover the vertical structural sleeve 29.

Other embodiments of the invention and other variations and modifications of the embodiments described above will be obvious to a person skilled in the art. Therefore, the foregoing is intended to be merely illustrative of the invention and the invention is limited only by the following claims.

What is claimed is:

1. A mobile roping training apparatus comprising:

a) a simulated animal torso, including simulated hind quarters;

b) a pair of simulated hind legs;

c) rear body pivoting means for pivotally attaching the simulated hind legs to the rear of the simulated animal torso, said means providing for one of said legs to be pivotally attached to a side of the simulated animal torso in an anatomical position and the other of said legs to be pivotally attached to an opposite side of the simulated animal torso in an anatomical position, said rear body pivoting means providing for forward and backward pivoting of said hind legs about said rear body pivoting means;

d) support means for maintaining said simulated animal torso and pivotally attached legs in a desired position for roping training;

e) front body pivoting means providing for pivotal attachment of the simulated animal torso to the support means and providing for up and down pivoting of the simulated animal torso about said body pivoting means, thereby providing for up and down movement of the simulated animal torso and the pivotally attached hind legs;

f) energy supply means;

g) drive means connected to said energy supply means and pivotally connected to the hind legs, said drive means providing for the transfer of energy from said energy supply means to the hind legs and the torso, providing for repetitive back and forth pivoting of the legs about the rear body pivot means, and providing for said up and down movement of the simulated animal torso and the attached hind legs, whereby the drive means causes the hind legs to pivot and move in a rearward direction as the animal torso moves toward a down position, and causes the hind legs to pivot and move in a forward direction as the animal torso moves toward an up position, thereby simulating the torso and hind leg movement of a running animal.

2. An apparatus as claimed in claim 1 wherein said simulated animal torso comprises a hollow shell.

3. An apparatus as claimed in claim 1 wherein said simulated animal torso comprises a hollow shell and said hollow shell and said simulated hind legs are constructed of resilient material.

4. An apparatus as claimed in claim 1 further comprising a load spring which connects the simulated animal torso to the support means, thereby reducing the force required of the energy supply means to raise the legs and the torso and reducing vibration.

5. An apparatus as claimed in claim 1 wherein the support means further comprises means for adjusting the height of the torso and legs above ground level.

6. An apparatus as claimed in claim 1 wherein said support means further comprises frame skid members which allow the apparatus to slide along the ground when it is being towed for moving practice.

7. An apparatus as claimed in claim 1 further comprising means for attaching said support means to a towing device and towing said apparatus for moving practice.

8. An apparatus as claimed in claim 1 wherein said energy supply means comprises an electric motor which is attached to said support means, and a means for connecting the motor to a source of electric power.

9. An apparatus as claimed in claim 1 wherein said energy supply means comprises an electric motor and an interconnected battery which are attached to said support means.

10. An apparatus as claimed in claim 1 wherein said drive means further comprises means for adjusting the speed of the leg and torso movement.

11. A mobile roping training apparatus comprising:

a) a simulated animal torso including simulated hind quarters, said simulated animal torso comprising a hollow shell with an external form providing said animal torso simulation;

b) a pair of simulated hind legs;

c) a rear body pivot shaft extending from side to side through the hind quarters of the simulated animal torso and passing through a top portion of each hind leg, thereby pivotally attaching one of said legs to one side and the other of said legs to an opposite side of the simulated animal torso inside said shell in an anatomical position;

d) a support frame for maintaining said simulated animal torso and pivotally attached legs in a desired position for roping training;

e) a central structural member extending inside said shell to the support frame;

f) means for connecting the central structural member to the support frame;

g) a front body pivot shaft extending through the simulated animal torso;

h) means for attaching said front body pivot shaft to the central structural member;

i) energy supply means;

j) a hind leg drive mechanism comprising 1) a pair of drive cams, 2) a drive shaft connecting said drive cams, one said drive cam being affixed to one end of said drive shaft and the other said drive cam being affixed to the opposite end of said drive shaft, the desired axis of rotation of the drive cams being aligned with the center of the drive shaft, 3) a pair of hind leg pivot shafts, one said hind leg pivot shaft pivotally connecting one said hind leg with one of said drive cams, and the other said hind leg pivot shaft pivotally connecting the other said hind leg with the other said drive cam, thereby providing for repetitive back and forth pivoting of the legs about the rear body pivot shaft, and providing for up and down movement of the rear of the simulated animal torso and the attached hind legs, whereby the drive means causes the hind legs to pivot and move in a rearward direction as the animal torso moves toward a down position, and causes the hind legs to pivot and move in a forward direction as the animal moves toward an up position, thereby simulating the torso and hind leg movement of a running animal, and 4) means for driving the hind leg drive mechanism with the energy supply means.

12. An apparatus as claimed in claim 11 wherein said hollow shell is a thin shell of resilient material and said hind legs are constructed of resilient material.

13. An apparatus as claimed in claim 11 further comprising a load spring which connects the simulated torso and the support frame, thereby reducing the force required of the energy supply means to raise the legs and the torso and reducing vibration.

14. An apparatus as claimed in claim 11 wherein the support frame further comprises means for adjusting the height of the torso and legs above ground level.

15. An apparatus as claimed in claim 11 wherein said support frame further comprises skid frame members which allow the apparatus to slide along the ground when it is being towed for moving practice.

16. An apparatus as claimed in claim 11 wherein said support frame further comprises means for attaching said support frame to a towing device and towing said apparatus for moving practice.

17. An apparatus as claimed in claim 11 wherein said energy supply means comprises an electric motor which is attached to said central structural member, and means for connecting the electric motor to a source of electric power.

18. An apparatus as claimed in claim 11 wherein said energy supply means comprises an electric motor, which is attached to said central structural member, and an interconnected battery, which is attached to said support frame.

19. An apparatus as claimed in claim 11 wherein said drive mechanism further comprises means for adjusting the speed of the leg and torso movement.

20. An apparatus as claimed in claim 11 wherein said energy supply means comprises an electric motor and motor mount and means for connecting the motor to a source of electric power, said electric motor being attached to said motor mount, said motor mount comprising a tubular sleeve which tracks upon the central structural member, said electric motor having a motor pulley, said drive mechanism having a split drive pulley and a drive belt connecting the motor pulley with the drive pulley, said drive mechanism having a spring loaded transmission and a threaded tension shaft which is threaded into a threaded receptacle on the motor mount and extends rearward and is anchored at the rear of the central structural member.

21. An apparatus as claimed in claim 11 wherein said energy supply means comprises an electric motor, motor mount, battery, battery stand, and means for connecting the battery to the electric motor, said electric motor being attached to said motor mount, said motor mount comprising a tubular sleeve which tracks upon the central structural member, said battery stand being attached to said support frame, said battery being attached to said battery stand, said electric motor having a motor pulley, said drive mechanism having a split drive pulley and a drive belt connecting the motor pulley with the drive pulley, said drive mechanism having a spring loaded transmission and a threaded tension shaft which is threaded into a threaded receptacle on the motor mount and extends rearward and is anchored at the rear of the central structural member.

22. A mobile roping training apparatus comprising:

a) a simulated animal torso including simulated hind quarters, said simulated animal torso comprising a hollow shell with an external form providing said animal torso simulation;

b) a pair of simulated hind legs;

c) a rear body pivot shaft extending from side to side through the hind quarters of the simulated animal torso and passing through a top portion of each hind leg, thereby pivotally attaching one of said legs to one side and the other of said legs to the opposite side of the simulated animal torso inside said shell in an anatomical position;

d) a support frame for maintaining said simulated animal torso and pivotally attached legs in a desired position for roping training;

e) a central structural member extending inside said shell to the support frame;

f) means for connecting the central structural member to the support frame;

g) a front body pivot shaft extending through the simulated animal torso;

h) means for attaching said body pivot shaft to the central structural member;

i) a source of electric power;

j) an electric motor with a motor pulley and means for connecting the motor to said source of electric power;

k) a motor mount comprising a tubular sleeve which is sized to track upon the central structural member, said electric motor being mounted on said motor mount with the axis of rotation of the motor and the motor pulley being perpendicular to the central structural member;

l) a hind leg drive mechanism comprising 1) a pair of drive cams, 2) a radially split drive pulley, 3) a drive belt connecting the drive pulley and the motor pulley, 4) a spring loaded transmission, said spring loaded transmission urging the halves of the split drive pulley together, the degree of separation of the halves of the split drive pulley and the extent of penetration of the drive belt between the halves of the drive pulley being determined by the amount of tension on the drive belt, 5) a threaded tension shaft which is threaded into a threaded receptacle on the motor mount and extends rearward and is anchored at the rear of the central structural member, thereby providing for adjustment of the tension on the drive belt, 6) a drive shaft connecting the drive cams and the drive pulley, one said drive cam being affixed to one end of said drive shaft and the other said drive cam being affixed to the opposite end of said drive shaft, the desired axis of rotation of each drive cam and the drive pulley being aligned with the center of the drive shaft, 7) means for connecting the drive shaft to the central structural member;

8) a pair of hind leg pivot shafts, one said hind leg pivot shaft pivotally connecting one said hind leg with one said drive cam and the other said hind leg pivot shaft pivotally connecting the other said hind leg with the other said drive cam, thereby providing for repetitive back and forth pivoting of the legs about the rear body pivot shaft, and providing for up and down movement of the simulated animal torso and the attached hind legs, whereby the drive means causes the hind legs to pivot and move in a rearward direction as the animal torso moves toward a down position, and causes the hind legs to pivot and move in a forward direction as the animal torso moves toward an up position, thereby simulating the torso and hind leg movement of a running animal.

23. An apparatus as claimed in claim 22 wherein said hollow shell is a thin shell of resilient material and said hind legs are constructed of resilient material.

24. An apparatus as claimed in claim 22 further comprising a load spring which connects the simulated animal torso and the support frame, thereby reducing the force required of the energy supply means to raise the legs and the torso and reducing vibration.

25. An apparatus as claimed in claim 22 wherein the support frame further comprises a means for adjusting the height of the torso and legs above ground level.

26. An apparatus as claimed in claim 22 wherein said support frame further comprises skid frame members which allow the apparatus to slide along the ground when it is being towed for moving practice.

27. An apparatus as claimed in claim 22 wherein said support frame further comprises means for attaching said support frame to a towing device and towing said apparatus for moving practice.

28. An apparatus as claimed in claim 22 further comprising a battery which is attached to said support frame and means for connecting the battery to the electric motor.

29. An apparatus as claimed in claim 22 wherein the central structural member is a tubular beam.

* * * * *